US011598499B1

(12) United States Patent
Zhu et al.

(10) Patent No.: US 11,598,499 B1
(45) Date of Patent: Mar. 7, 2023

(54) LED STRIP LAMP HAVING REMOVABLE POWER SUPPLY MODULE

(71) Applicant: Dong Guan Technomate Metal Ware Manufactory Ltd, Guang Dong (CN)

(72) Inventors: Fanggen Zhu, Guang Dong (CN); Qiaohui Deng, Guang Dong (CN)

(73) Assignee: Dong Guan Technomate Metal Ware Manufactory Ltd, Guang Dong (CN)

( * ) Notice: Subject to any disclaimer, the term of this patent is extended or adjusted under 35 U.S.C. 154(b) by 0 days.

(21) Appl. No.: 17/683,351

(22) Filed: Mar. 1, 2022

(51) Int. Cl.

| | |
|---|---|
| ***F21S 4/28*** | (2016.01) |
| ***F21V 23/06*** | (2006.01) |
| ***F21V 23/04*** | (2006.01) |
| ***F21V 23/00*** | (2015.01) |
| *F21Y 115/10* | (2016.01) |

(52) U.S. Cl.
CPC ..... *F21S 4/28* (2016.01); *F21V 23/003* (2013.01); *F21V 23/04* (2013.01); *F21V 23/06* (2013.01); *F21Y 2115/10* (2016.08)

(58) Field of Classification Search
CPC ..... F21S 8/04; F21S 4/28; F21S 9/61; F21S 4/20; F21V 23/003; F21V 23/06; F21K 9/61
See application file for complete search history.

(56) References Cited

U.S. PATENT DOCUMENTS

| | | | | |
|---|---|---|---|---|
| 6,880,963 | B2 * | 4/2005 | Luig | G02B 6/0081 362/555 |
| 7,815,332 | B1 * | 10/2010 | Smith | F21V 23/06 362/147 |
| 8,915,636 | B2 * | 12/2014 | Araki | G02F 1/133615 362/147 |
| 9,157,622 | B2 * | 10/2015 | Yanping | F21V 21/025 |
| 9,476,552 | B2 * | 10/2016 | Myers | F21S 8/026 |
| 10,466,411 | B2 * | 11/2019 | Conrad | F21V 19/0045 |
| 10,473,849 | B2 * | 11/2019 | Boulanger | F21V 21/03 |
| 10,605,414 | B1 * | 3/2020 | Garrett | F21K 9/61 |
| 2005/0180172 | A1 * | 8/2005 | Jang | H01J 61/56 362/800 |
| 2012/0020109 | A1 * | 1/2012 | Kim | G02B 6/0078 362/85 |
| 2012/0081923 | A1 * | 4/2012 | Li | F21V 21/096 362/612 |
| 2019/0346089 | A1 * | 11/2019 | Rashidi Doust | F21K 9/61 |
| 2020/0400297 | A1 * | 12/2020 | Hou | F21V 15/012 |

* cited by examiner

*Primary Examiner* — Ismael Negron
(74) *Attorney, Agent, or Firm* — JCIPRNET

(57) ABSTRACT

A strip lamp includes an illuminating lamp and a power supply module. The illuminating lamp includes a lamp body, a light guide plate, a control panel, an LED lamp panel and a PCBA mainboard. The LED lamp panel and the PCBA mainboard are installed in the lamp body. The light guide plate is disposed over the lamp body and is located on a light emitting side of the LED lamp panel. The PCBA mainboard is provided with a first interface at an end of the lamp body. An opening matched with the first interface is formed in a position, closed to the first interface, of the lamp body. The charging PCB is provided with a second interface extending out of a connector of the power supply module. The independent rechargeable power supply module is used to supply power to the illuminating lamp.

8 Claims, 4 Drawing Sheets

LED STRIP LAMP HAVING REMOVABLE POWER SUPPLY MODULE

BACKGROUND

Technical Field

The invention relates to the technical field of illuminating lamps, in particular to a strip lamp.

Description of Related Art

The strip lamp is an illuminating lamp consisting of an LED light source, a control device and a shell. Induction cabinet lamps are one type of strip lamps which are widely applied to household cabinets, wardrobes, bedsides, corridors, and other environments in life. When the induction cabinet lamps are used for illumination in cabinets and wardrobes or for night illumination, different illuminating modes such as long-term on/off and an intelligent induction function may be selected according to different requirements in life, and the illuminating effect is good.

However, most existing induction cabinet lamps use a dry battery or an AC mains supply as a power supply system. However, in some environments where a mains supply system is not available, power supply to the induction cabinet lamps will be limited. Although the dry battery can relieve the power supply pressure in a case where a mains supply is not available, it cannot realize long-term effective power supply for illumination and needs to be changed regularly, thus being inconvenient to use and not environmentally friendly.

Thus, it is necessary to improve the structure of the strip lamps in the prior art to better solve the above-mentioned technical problems.

SUMMARY

To solve the above-mentioned problems, the invention provides a strip lamp which is simple in structure, reasonable in design, capable of providing long-term effective illumination through an independent rechargeable module, and capable of being repeatedly charged for use, thus realizing more convenient and environmentally-friendly illumination in life.

The technical solution adopted by the invention is as follows.

A strip lamp comprises an illuminating lamp and a power supply module. The illuminating lamp is detachably connected to the power supply module and comprises a lamp body, a light guide plate, a control panel, an LED lamp panel and a PCBA mainboard, the LED lamp panel and the PCBA mainboard are installed in the lamp body, and the LED lamp panel is connected to the PCBA mainboard. The light guide plate is disposed over the lamp body and is located on a light-emitting side of the LED lamp panel. The control panel is disposed over the lamp body and is connected to the PCBA mainboard. The PCBA mainboard is provided with a first interface located at one end of the lamp body, and an opening matched with the first interface is formed in a position, close to the first interface, of the lamp body. The power supply module comprises a shell, a connector, a charging assembly and a charging PCB, the connector is installed at one end of the shell, the charging assembly and the charging PCB are disposed in the shell, the charging assembly is connected to the charging PCB, the charging PCB is provided with a second interface which extends out of the connector, and when the illuminating lamp is connected to the power supply module, the first interface is connected to the second interface.

As a further improvement of the above technical solution, the PCBA mainboard is provided with a switch module, an illuminating mode control module, an illuminating brightness control mode, an illuminating color temperature control module and an induction mode control module.

As a further improvement of the above technical solution, the control panel is provided with a sensor, a key switch and an indicator light, and the sensor, the key switch and the indicator light are disposed on the control panel and are connected to the PCBA mainboard.

As a further improvement of the above technical solution, the first interface is a USB female interface, and the second interface is a USB male interface.

As a further improvement of the above technical solution, a magnet is disposed in the lamp body, a limiting groove is formed in a side, away from the light guide plate, of the lamp body, and a fixing piece is disposed in the limiting groove.

As a further improvement of the above technical solution, a magnet is disposed in the lamp body, and a mounting patch is disposed on a side, away from the light guide plate, of the lamp body.

As a further improvement of the above technical solution, the end, formed with the opening, of the lamp body is provided with a joint groove which is concaved inwards, a protrusion matched with the joint groove is disposed on the connector, and when the first interface is connected to the second interface, the protrusion is clamped in the joint groove.

As a further improvement of the above technical solution, a set of positioning posts are disposed in the joint groove, and a set of positioning holes matched with the positioning posts are disposed on the protrusion.

As a further improvement of the above technical solution, the joint groove is square, and arc notches are formed in two sides of the protrusion.

As a further improvement of the above technical solution, the strip lamp further comprises a diffusion plate. The diffusion plate is disposed in the lamp body and is attached to the light guide plate, a cover plate is disposed at one end of the lamp body, a battery box cover is disposed at one end of the shell, and decorative lines are disposed on an outer side of the lamp body and an outer side of the shell respectively.

The invention has the following beneficial effects.

The strip lamp of the invention comprises an illuminating lamp and a power supply module. The illuminating lamp is detachably connected to the power supply module and comprises a lamp body, a light guide plate, a control panel, an LED lamp panel and a PCBA mainboard, the LED lamp panel and the PCBA mainboard are installed in the lamp body, and the LED lamp panel is connected to the PCBA mainboard. The light guide plate is disposed over the lamp body and is located on a light-emitting side of the LED lamp panel. The control panel is disposed over the lamp body and is connected to the PCBA mainboard. The PCBA mainboard is provided with a first interface located at one end of the lamp body, and an opening matched with the first interface is formed in a position, close to the first interface, of the lamp body. The power supply module comprises a shell, a connector, a charging assembly and a charging PCB, the connector is installed at one end of the shell, the charging assembly and the charging PCB are disposed in the shell, the charging assembly is connected to the charging PCB, the charging PCB is provided with a second interface which extends out of the connector, and when the illuminating lamp is connected to the power supply module, the first interface is connected to the second interface. According to the invention, the power supply module detachably connected to the illuminating lamp is used to supply power, the power supply module can be disassembled to be charged and then be connected to the illuminating lamp to supply power to the illuminating lamp in the using process, and the structure is simple, and the design is reasonable. The independent rechargeable power supply module is used to provide long-term effective illumination and can be repeatedly charged for use, so that more convenient and environmentally-friendly illumination is realized in life.

DESCRIPTION OF THE EMBODIMENTS

Figure 1:
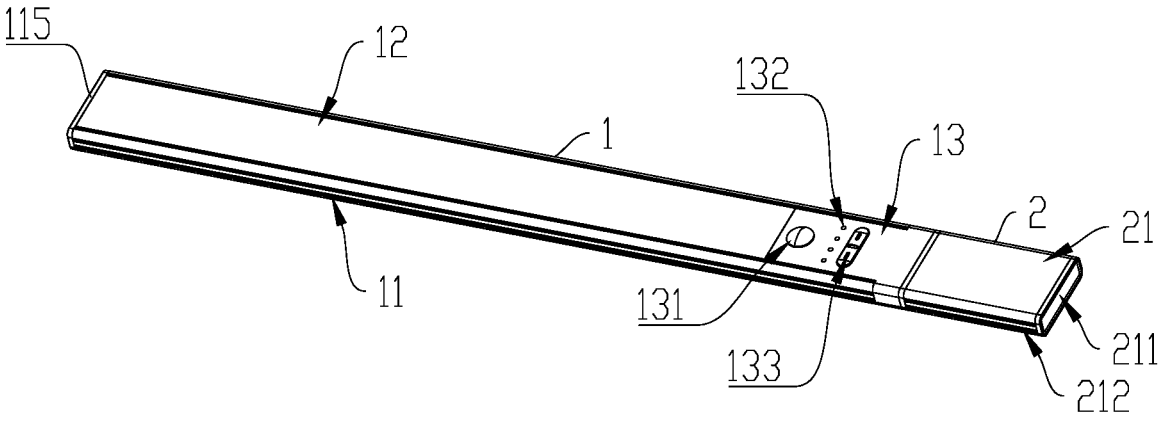
FIG. 1 is a structural diagram of some embodiments of the invention.
Figure 2:
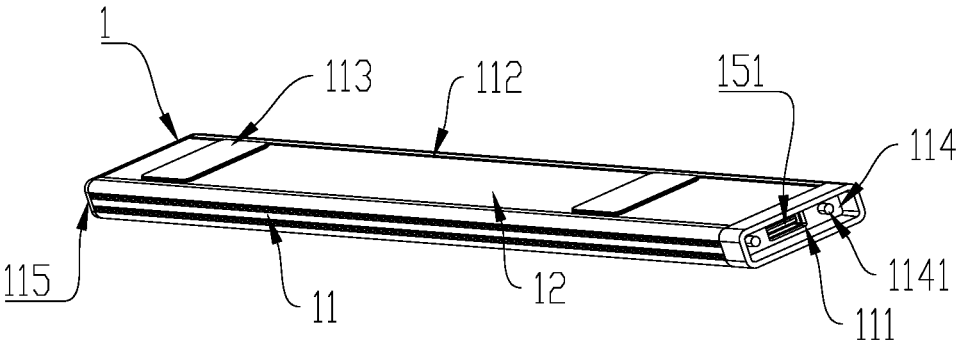
FIG. 2 is a structural diagram of an illuminating lamp of the invention.
Figure 3:
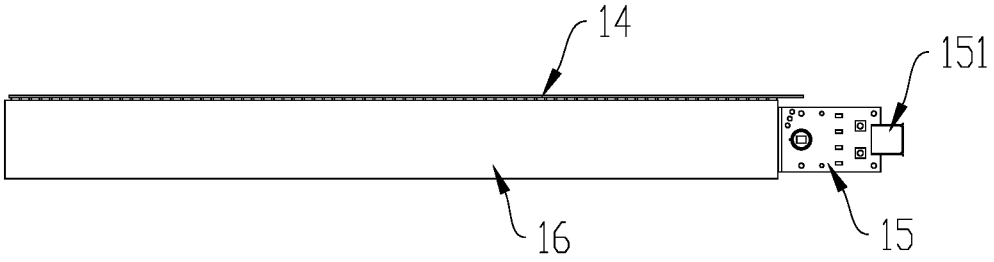
FIG. 3 is an internal structural diagram of the illuminating lamp of the invention.
Figure 4:
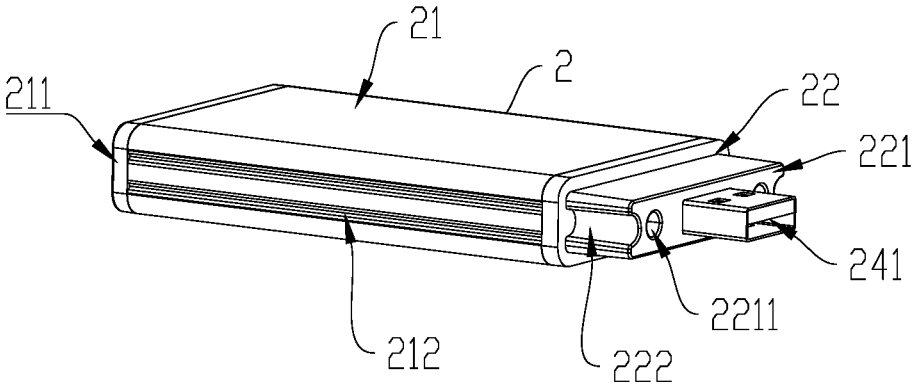
FIG. 4 is a structural diagram of a power supply module of the invention.
Figure 5:
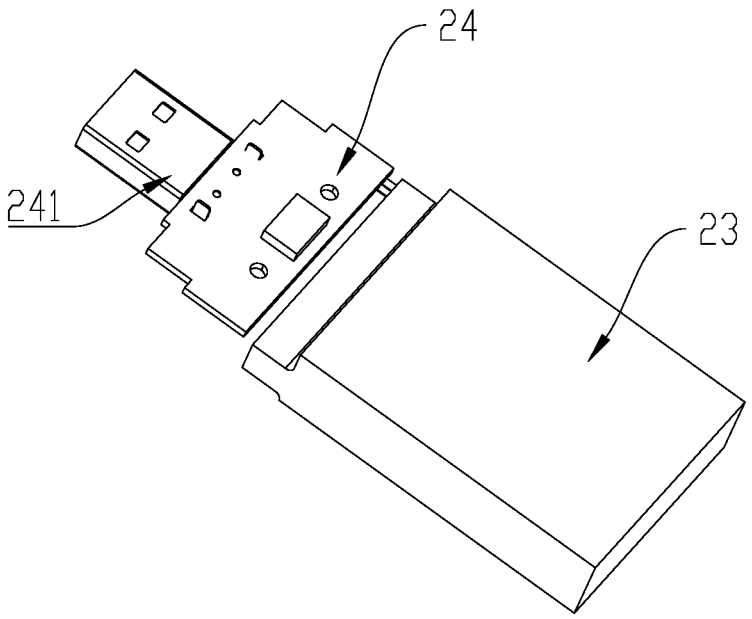
FIG. 5 is an internal structural diagram of the power supply module of the invention.

The technical solution of the invention will be clearly and completely described below in conjunction with the accompanying drawings. Obviously, the embodiments in the following description are merely illustrative ones, and are not all possible ones of the invention. All other embodiments obtained by those ordinarily skilled in the art based on the following ones without creative labor should also fall within the protection scope of the invention.

It should be noted that the terms such as "central", "upper", "lower", "left", "right", "vertical", "horizontal", "inner" and "outer" in the description of the invention are used to indicate directional or positional relations based on the accompanying drawings merely for the purpose of facilitating and simplifying the description of the invention, do not indicate or imply that a device or element referred to must be in a specific direction, or be configured and operated in a specific direction, and thus should not be construed as limitations of the invention. In addition, the terms such as "first", "second" and "third" are merely for the purpose of description, and should not be construed as indicating or implying relative importance.

It should be noted that, unless otherwise specified, the terms such as "install", "link" and "connect" in the description of the invention should be broadly understood. For example, "connect" may refer to fixed connection, detachable connection or integrated connection; or, mechanical connection or electrical connection; or, direct connection, indirect connection through an intermediate, or internal communication of two elements. Those ordinarily skilled in the art may understand the specific meaning of these terms in the invention as the case may be.

As shown in FIG. 1 to FIG. 5, this embodiment provides a strip lamp. The strip lamp includes an illuminating lamp 1 and a power supply module 2. The illuminating lamp 1 is detachably connected to the power supply module 2 and comprises a lamp body 11, a light guide plate 12, a control panel 13, an LED lamp panel 14 and a PCBA mainboard 15. The LED lamp panel 14 and the PCBA mainboard 15 are installed in the lamp body 11. The LED lamp panel 14 is connected to the PCBA mainboard 15, and the light guide plate 12 is disposed over the lamp body 11 and is located on a light emitting side of the LED lamp panel 14. The control panel 13 is disposed over the lamp body 11 and is connected to the PCBA mainboard 15, and the PCBA mainboard 15 is provided with a first interface 151 which is located at one end of the lamp body 11. An opening 111 matched with the first interface 151 is formed in a position, close to the first interface 151, of the lamp body 11. The power supply module 2 comprises a shell 21, a connector 22, a charging assembly 23 and a charging PCB 24. The connector 22 is installed at one end of the shell 21, the charging assembly 23 and the charging PCB 24 are disposed in the shell 21, the charging assembly 23 is connected to the charging PCB 24, and the charging PCB 24 is provided with a second interface 241 which extends out of the connector 22. When the illuminating lamp 1 is connected to the power supply module 2, the first interface 151 is connected to the second interface 241. Specifically, the charging assembly 23 in this embodiment may consist of a plurality of rechargeable batteries and can be charged and discharged repeatedly to supply power to the illuminating lamp 1. According to the invention, the power supply module 2 detachably connected to the illuminating lamp 1 is used to supply power. During use, the illuminating lamp 1 is attracted or bonded in a space to be illuminated, and then the power supply module 2 is connected to the illuminating lamp 1 to supply power for illumination. When the power of the power supply module 2 is used up, the power supply module 2 is disassembled to be charged and is then connected to the illuminating lamp 1 again to supply power to the illuminating lamp 1. The strip lamp in this embodiment is simple in structure, reasonable in design, capable of providing long-term effective illumination through the independent rechargeable power supply module 2, and capable of being repeatedly charged for use, thus realizing more convenient and environmentally-friendly illumination in life. In other embodiments, the illuminating lamp 1 and the power supply module 2 may be both disassembled to be charged, cleaned, maintained or repaired or for part replacement.

In some embodiments of the application, the PCBA mainboard 15 is provided with a switch module, an illuminating mode control module, an illuminating brightness control module, an illuminating color temperature control module and an induction mode control module. In this embodiment, the illuminating mode, illuminating color temperature, illuminating brightness and induction mode of the illuminating lamp 1 are controlled and selected through multiple functional modules disposed on the PCBA mainboard 15. For example, a larger or smaller induction distance is selected to better meet illuminating requirements, so that intelligent and personalized illumination is realized.

On the basis of the above embodiment, the control panel 13 is provided with a sensor 131, a key switch 132 and an indicator light 133. The sensor 131, the key switch 132 and the indicator light 133 are installed on the control panel 13 and are connected to the PCBA mainboard 15. As specifically shown in this embodiment, the sensor 131 is arranged to sense the approach of humans for spatial illumination, and the induction distance is selected and controlled by means of the key switch 132, so that using is convenient. Specifically, in this embodiment, the key switch 132 and the indicator light 133 are used to select the illuminating condition. Compared with a touch switch, the key switch 132 has a press feedback function during use and is good in operation accuracy, and the indicator light 133 is able to fulfill a corresponding indication function, so that the illuminating lamp 1 can be better controlled and used.

In some embodiments of the application, the first interface 151 is a USB female interface, and the second interface 241 is a USB male interface. As specifically shown in this embodiment, the connection and conduction between the illuminating lamp 1 and the power supply module 2 are realized through USB interfaces, so that the structure is simple, plugging is easy, the conduction stability is good, and using is convenient.

In some embodiments of the application, a magnet is disposed in the lamp body 11, a limiting groove 112 is formed in a side, away from the light guide plate 12, of the lamp body 11, and a fixing piece 113 is disposed in the limiting groove 112. Specifically, in this embodiment, the fixing piece 113 may be a patch, which is installed in the limiting groove 112 through the cooperation of an iron sheet and a magnet. The illuminating lamp 1 can be installed through magnetic attraction of the magnet, thereby being easy to assemble and disassemble. In addition, by adoption of the connection method based on the cooperation of the iron sheet and the magnet, the lamp body 11 can be made of various non-magnetic materials without being limited, and thus, the appearance of the illuminating lamp 1 of the application is more beautiful and diversified.

Figure 6:
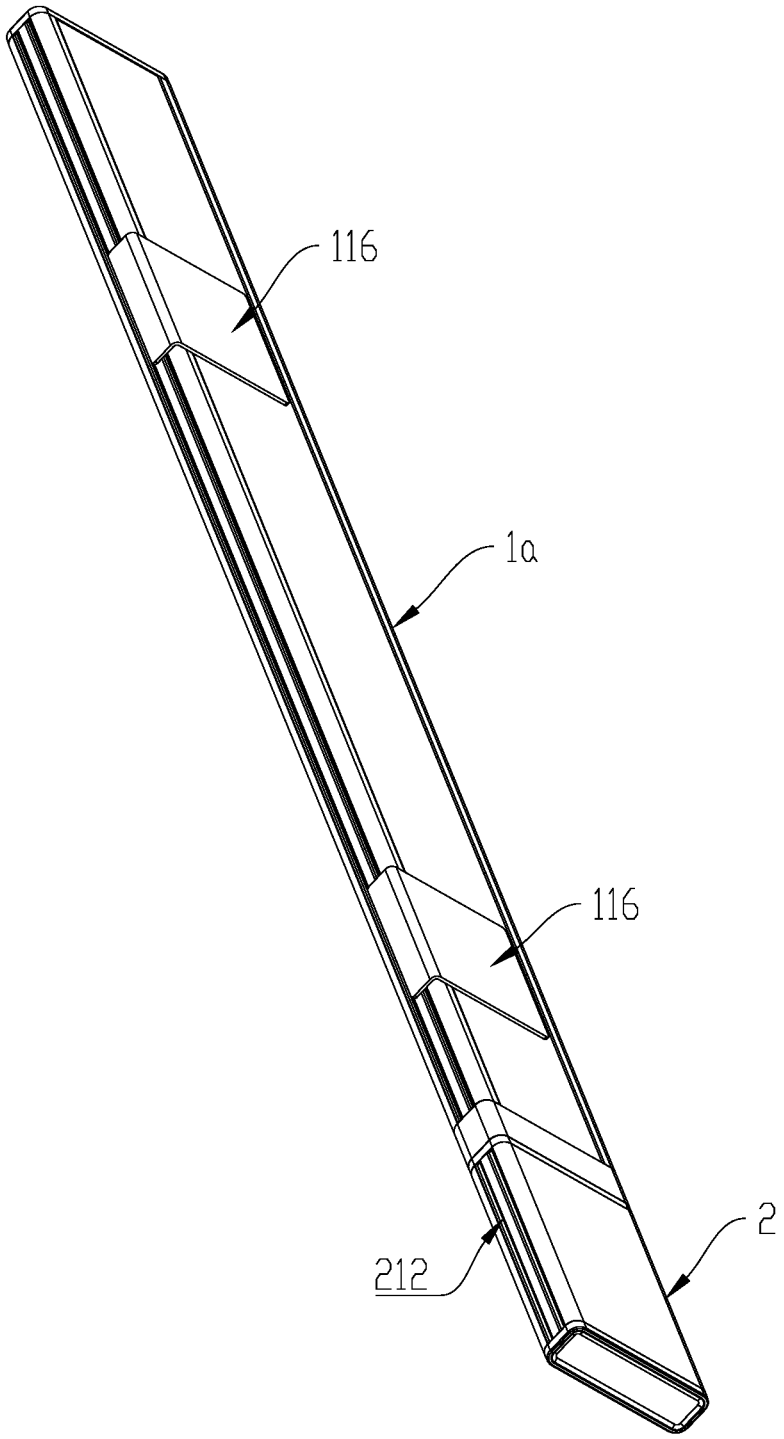
FIG. 6 is a structural diagram of some embodiments of the invention.

FIG. 6 is a structural diagram of some embodiments of the invention. Referring to FIG. 6, the limiting groove 112 may be omitted, an L-shaped mounting patch 116 is directly used as the fixing piece 113, and the mounting patch 116 is buckled on the lamp body 11. When an external assembly to be installed is made of wood, plastic or other non-magnetic materials, the mounting patch 116 is installed by bonding, and then the illuminating lamp 1*a* is connected to the external assembly by magnetic attraction of the magnet and the mounting patch 116. If the external assembly to be installed is made of a metal material, the external assembly is installed directly by magnetic attraction. The L-shaped mounting patch 116 in this embodiment is beneficial to installation and has a guiding and positioning function. Specifically, the mounting path 116 may be made of a metal material such as iron.

Referring to FIGS. 1-5, in some embodiments of the application, the end, formed with the opening 111, of the lamp body 11 is provided with a joint groove 114 which is concaved inwards, the connector 22 is provided with a protrusion 221 matched with the joint groove 114, and when the first interface 151 is connected to the second interface 241, the protrusion 221 is clamped in the joint groove 114. Through such an arrangement in this embodiment, the power supply module 2 and the illuminating lamp 1 can be tightly joined and steadily connected, and the joint of the power supply module 2 and the illuminating lamp 1 is continuous and smooth, so the overall appearance of the strip lamp of the application is beautiful.

On the basis of the above embodiment, a set of positioning posts 1141 are disposed in the joint groove 113, and a set of positioning holes 2211 matched with the positioning posts 1141 are formed in the protrusion 221. Through such an arrangement in this embodiment, a guiding and positioning effect can be realized when the illuminating lamp 1 and the power supply module 2 are connected, so that the first interface 151 and the second interface 241 can be connected smoothly, and the structure is simple, and using is convenient.

In some embodiments of the application, the joint groove 114 is square, and arc notches 222 are formed in two sides of the protrusion 221. In this embodiment, the joint groove 114 is square, thereby being convenient to machine and capable of being easily connected to the connector 22, and users can hold the strip lamp by hand by means of the arc notches in the two sides of the protrusion 221.

In some embodiments of the application, the illuminating lamp 1 further comprises a diffusion plate 16 disposed in the lamp body 11 and attached to the light guide plate 12. The diffusion plate 16 can increase the illuminating brightness, enlarge the heat-dissipation area and prolong the service life of the LED lamp panel, and is simple in structural design and high in practicability.

In some embodiments of the application, a cover plate 115 is disposed at one end of the lamp body 11, a battery box cover 211 is disposed at one end of the shell 21, and decorative lines 212 are disposed on an outer side of the lamp body 11 and an outer side of the shell 21 respectively. The cover plate 115 is disposed on the lamp body 11 and detachably connected to the lamp body 11, so that using is convenient. The battery box cover 211 is disposed and can be opened to take or place rechargeable batteries, so that the structure is simple, and using is convenient. The decorative lines 212 disposed on the outer side of the lamp body 11 and the outer side of the shell 21 can improve the aesthetics of the appearance of the lamp body, so as to better meet visual requirements.

The description of reference terms such as "one embodiment", "some embodiments", illustrative embodiments", "example", "specific example", and "some examples" in this specification is intended to indicate that specific features, structures, materials or characteristics described in conjunction with said embodiment or example are included in at least one embodiment or example of the invention. In this specification, the illustrative description of these terms does not definitely indicate the same embodiment or example. The specific features, structures, materials or characteristics may be properly combined in any one or more embodiments or examples.

Although the embodiments of the invention have been illustrated and described above, those ordinarily skilled in the art would appreciate that different variations, modifications, substitutions and transformations can be made to these embodiments without departing from the principle and spirit of the invention.

The above embodiments only illustrate several implementations of the invention, and are specifically described in detail, but these embodiments should not be understood as limiting the scope of the patent of invention. It should be noted that those ordinarily skilled in the art can make different transformations and improvements without departing from the concept of the invention, and all these transformations and improvements should fall within the protections scope of the invention. Thus, the protection scope of the patent of invention should be defined by the appended claims and their equivalents.

What is claimed is:

1. A strip lamp comprising:

an illuminating lamp having a lamp body, a light-emitting diode (LED) lamp panel provided in the lamp body, a light guide plate disposed over the lamp body and located on a light emitting side of the LED lamp panel, a printed circuit board assembly (PCBA) mainboard provided in the lamp body and connected to the LED lamp panel, a first interface provided to the PCBA mainboard and located at an end of the lamp body, an opening matched with the first interface and formed in the lamp body at a position close to the first interface, a control panel disposed over the lamp body and connected to the PCBA mainboard; and a power supply module having a shell, a connector provided at an end of the shell, a charging assembly disposed in the shell, a charging PCB disposed in the shell and connected to the charging assembly, and a second interface provided in the charging PCB and extending out of the connector, wherein the illuminating lamp is detachably connected to the power supply module, such that the first interface is connected to the second interface when the illuminating lamp is connected to the power supply module.

2. The strip lamp according to claim 1, further comprising:

a switch module;

an illuminating mode control module;

an illuminating brightness control module;

an illuminating color temperature control module; and an induction mode control module, wherein the illumination mode control module, the illumination brightness control module, the illumination color control module, and the induction mode control module are provided in the PCBA mainboard.

3. The strip lamp according to claim 1, further comprising:

a sensor;

a key switch; and an indicator light, wherein the sensor, the key switch and the indicator light are disposed on the control panel and are connected to the PCBA mainboard.

4. The strip lamp according to claim 1, wherein the first interface is a universal serial bus (USB) female interface, and the second interface is a USB male interface.

5. The strip lamp according to claim 1, further comprising:

a diffusion plate disposed in the lamp body and attached to the light guide plate;

a cover plate disposed at an end of the lamp body;

a battery box cover disposed at an end of the shell; and decorative lines disposed on an outer side of the lamp body and an outer side of the shell, respectively.

6. The strip lamp according to claim 1, further comprising:

an inwardly concave joint groove formed with the opening at the end of the lamp body; and a protrusion matched with the joint groove and disposed on the connector, wherein the protrusion is clamped in the joint groove when the first interface is connected to the second interface.

7. The strip lamp according to claim 6, further comprising:

a set of positioning posts disposed in the joint groove; and a set of positioning holes formed in the protrusion and matched with the positioning posts.

8. The strip lamp according to claim 6, further comprising:

arc notches formed in two sides of the protrusion, wherein the joint groove has a square shape.

* * * * *